US005167562A

United States Patent [19]

Axtell

[11] Patent Number: 5,167,562

[45] Date of Patent: Dec. 1, 1992

[54] TAIL PULL AND WING FLAP ANIMATION APPARATUS

[76] Inventor: Stephen B. Axtell, 230 Glencrest Cir., Ventura, Calif. 93003

[21] Appl. No.: 724,380

[22] Filed: Jun. 28, 1991

[51] Int. Cl.[5] ..... A63H 3/14; A63H 3/20

[52] U.S. Cl. ..... 446/329; 446/330

[58] Field of Search ..... 446/330, 331, 359, 367, 446/365, 366, 340, 361, 362, 327, 329

[56] References Cited

U.S. PATENT DOCUMENTS

| | | | |
|---|---|---|---|
| 227,933 | 5/1980 | Erichsen | 446/361 |
| 407,142 | 7/1989 | Wobito | 446/361 |
| 964,803 | 7/1910 | Olson | 446/361 |
| 2,155,665 | 4/1939 | Leeper | 446/327 |
| 2,401,456 | 6/1946 | Bresch | 446/190 |
| 2,714,784 | 8/1955 | Polk | 446/365 |
| 2,741,871 | 4/1956 | Polk | 446/365 |
| 3,008,266 | 11/1961 | Wagner | 446/361 |
| 3,094,331 | 6/1963 | Greene | 446/330 X |
| 3,199,248 | 8/1965 | Suzuki | 446/299 |
| 3,269,054 | 8/1966 | Taylor | 446/361 |
| 4,575,349 | 3/1986 | Plazza et al. | 446/330 |
| 4,718,877 | 1/1988 | Girsch et al. | 446/313 |
| 4,867,729 | 9/1989 | Weinman et al. | 446/330 |

*Primary Examiner*—Mickey Yu

*Attorney, Agent, or Firm*—J. Robert Cassidy

[57] ABSTRACT

Apparatus and methods to animate and impart life-like qualities and actions to an animal-type puppet. The apparatus having a tail which when pulled or released causes, via a linkage, one or more appendages, such as arms, legs or wings, of the puppet to become remotely animated. The appendage comprises a remotely actuated, cantilevered lever or pivotal rocker arm which moves through a generally curved path or pivotal arch in response to longitudinal movement of the tail.

8 Claims, 4 Drawing Sheets

FIG. 5
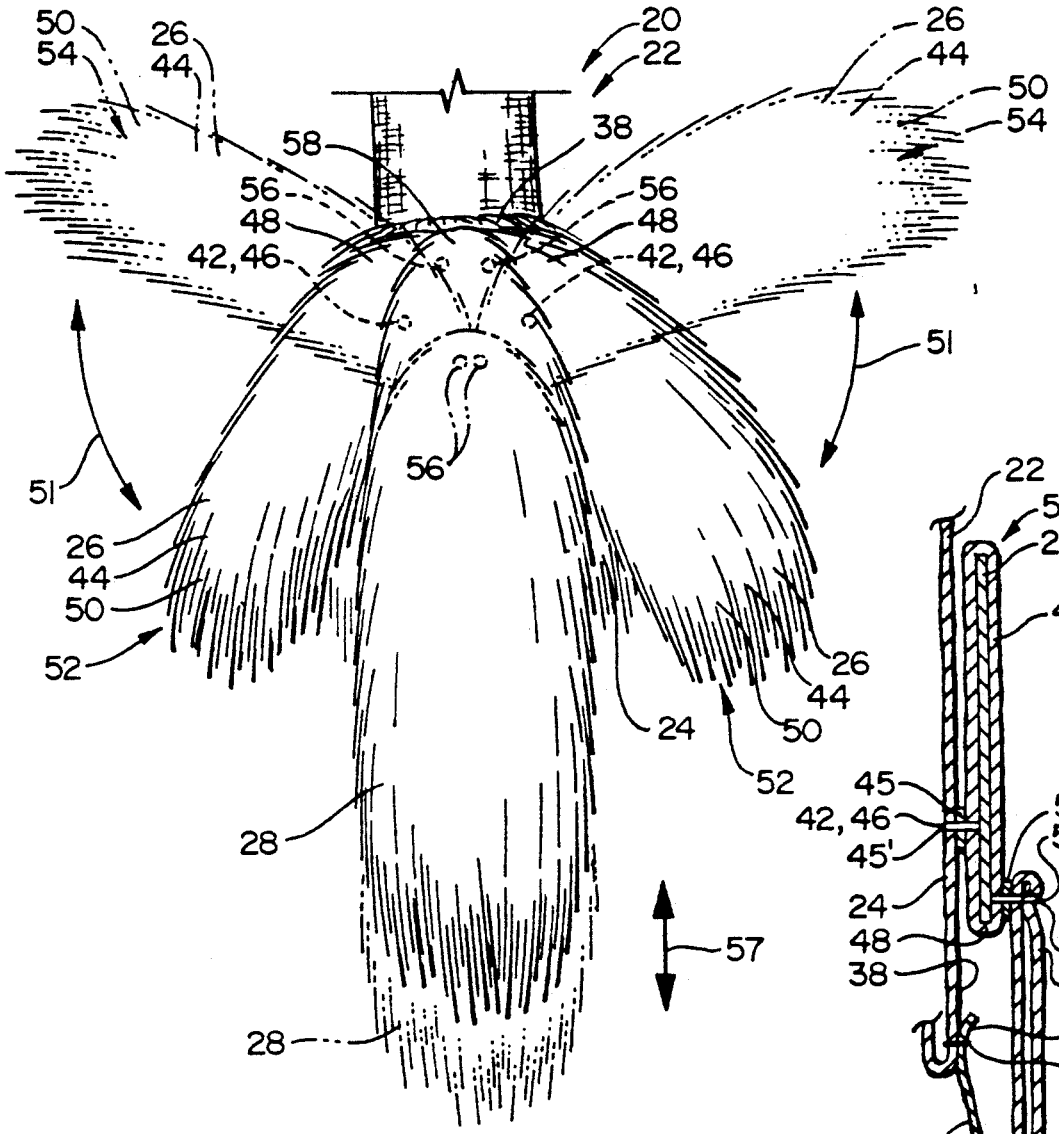
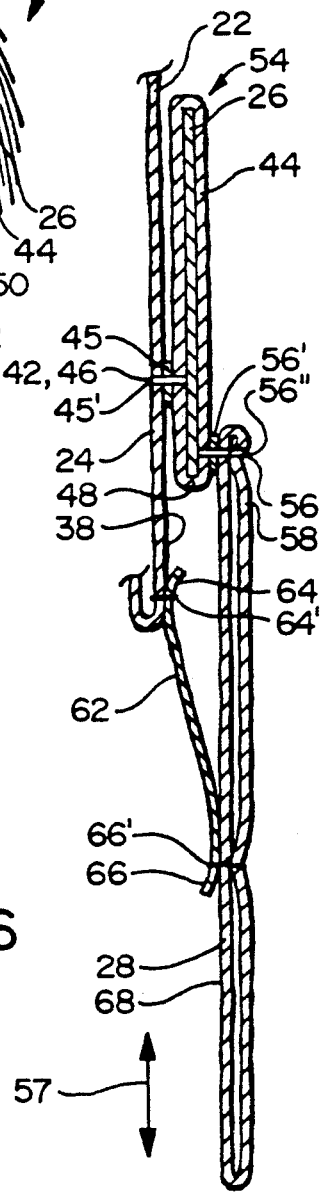
FIG. 6

TAIL PULL AND WING FLAP ANIMATION APPARATUS

COPYRIGHT NOTICE

© Copyright 1991, Cassidy, Vance & Tarleton, P. S. All Rights Reserved.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

TECHNICAL FIELD

This invention relates to apparatus and methods for animating a puppet; and, more particularly, to apparatus wherein movement of an elongated downwardly hanging tail of an animal-type puppet causes one or more appendages, such as arms, legs or wings, of the puppet to become animated.

BACKGROUND ART

Within the puppet and toy industries there has been a well recognized need for various apparatus and methods to remotely animate and impart life-like qualities and actions to a puppet. In an effort to satisfy this need, a wide variety of devices have been created. The following patents describe many of such devices: Erichsen (U.S. Pat. No. 227,933; issued May 25, 1880); Wobito (U.S. Pat. No. 407,142; issued Jul. 16, 1889); Olson (U.S. Pat. No. 964,803; issued Jul. 19, 1910); Polk (U.S. Pat. No. 2,714,784; issued Aug. 9, 1955); Polk (U.S. Pat. No. 2,714,871; issued Apr. 17, 1956); Wagner (U.S. Pat. No. 3,008,266; issued Nov. 14, 1961); Suzuki (U.S. Pat. No. 3,199,248; issued Aug. 10, 1965); Taylor (U.S. Pat. No. 3,269,054; issued Aug. 30, 1966); and Girsch et al. (U.S. Pat. No. 4,718,877; issued Jan. 12, 1988).

The inventor believes that the listed patents taken alone or in combination neither anticipate nor render obvious the present invention. These citations do not constitute an admission that such disclosures are relevant or material to the present claims. Rather, these citations relate only to the general field of the disclosure and are cited as constituting the closest art of which the inventor is aware.

DISCLOSURE OF INVENTION

The present invention may be used within the puppet, toy and entertainment industries. The invention comprises simple, functional, efficient, reliable, rugged, durable, compact, and easily used, constructed and assembled apparatus and methods to actuate and animate an animal-type puppet giving the puppet life-like qualities and actions.

More particularly, this invention provides apparatus and methods for remotely and automatically actuating movement of one or more appendages of an animal-type puppet in response to the pulling and releasing of a tail of the puppet. Specifically, the invention contemplates the use of a mechanical linkage between the puppet's tail and one or more appendages such that when the tail is pulled, the appendages wave or flap. To accomplish such movement, the puppet has a tail which is pivotally connected to one or more of the puppet's appendages. The appendages, in turn, are pivotally connected to the body of the puppet. The appendages normally lie in close proximity to the puppet's body. However, when the tail is pulled downward, the linkage causes the appendages to be simultaneously raised. As the downward tension on the tail is released, the appendages are urged back toward an initial position close to the body of the puppet.

Consequently, this tail-pull mechanism permits the puppeteer to reach over and pull the puppet's tail causing the appendages to slowly or frantically wave or flap. This enables the puppeteer to easily and automatically obtain quite a dramatic comic effect of having the puppet repetitively wave its arms or wings in distress in direct response to having its tail repetitively pulled and released.

In contrast to the prior art, only the animal puppet's body parts are visible. There are no strings or other foreign control devices which are readily within the view of the audience.

The present invention also overcomes many of the disadvantages found in the prior art. For example, many of the above-cited devices use complex and cumbersome means for imparting animated motion. Such means are also costly to manufacture and often require the use of pull strings or other visible foreign elements which would not be present if the puppet were in reality a live animal. In addition, without the present invention, it would be very difficult, if not impossible, to obtain a similar comic effect using visible, independent pull strings as taught in the prior art.

To achieve these general and specific objectives and to overcome the disadvantages of the prior art, the present invention comprises: a body, at least one elongated appendage, and an elongated tail.

The puppet may take any desired form. For example, the puppet could have a body and one or more appendages. The body is shaped to represent the torso of the puppet. The appendages simulate the arms, legs, or wings of the puppet. It is the primary concept of this invention, however, that the puppet has a tail such as is often found within the animal-and/or cartoon-animated kingdoms. The preferred form is that of a bird-type puppet having a body, wings and tail.

The present invention can be used with stationary, robotically-operated puppets, or similar structures which meet the particular needs of the puppeteer. Alternatively, the preferred embodiment of the invention comprises a puppet which is a hand-held unit mounted on the puppeteer's arm.

In addition to the traditional use of a puppet body, which is to contain and hide the hand or manipulating mechanism of the puppeteer, the body also serves and functions as a support structure to and upon which the appendage(s) and tail are attached.

The elongated appendage of the puppet is pivotally secured to the body at a generally fixed pivot point. This may be accomplished by providing the appendage with a flexible outer covering. The outer covering is then sewn, lo adhered or otherwise attached to the body of the puppet at a particular point. The point of attachment defines the pivot point.

Alternatively, an interlocking cylindrical pivot pin or other means may be used to engage both the appendage and body to pivotally secure the appendage to the body.

The pivot point serves as a fulcrum and axis of rotation for the appendage. In the preferred embodiment, the pivot point is located between the first end and second end of the appendage. This imparts a lever-type structure and movement to the appendage. In an alternative embodiment, the pivot point may be located at the first end of the appendage.

The appendage defines a pivotal, cantilevered lever, rocker arm, link or crank which can rotate or oscillate about the pivot point. The appendage has a first end located near the pivot point and has a second end which extends radially outward from the pivot point. The length of the appendage is largely dependent upon the desired size and shape of the puppet and the length of the curve the appendage is to pass through during animation.

When moved, the appendage rotates or oscillates about the axis of rotation to pass through a predetermined generally curved path. The appendage moves between a lowered, initial position and a raised, subsequent position. As illustrated in the drawings, the pivot point can be located within a central portion of the back of the puppet body. Consequently, when the appendage is in its initially lowered position, the appendage is oriented to the side and rear of the puppet body, being juxtaposed near the puppet body.

Rotation or pivotal movement of the appendage will urge the second end of the appendage outward toward its extended, raised position. When in its raised position, the second end of the appendage extends outwardly away from the body of the puppet.

The puppet is also provided with an elongated tail which is operatively connected to the appendage. For example, if the pivot point is located between the first and second ends of the appendage, the tail is operatively connected to the first end of the appendage.

The connection may be accomplished by providing the first end of the appendage with means for securing the upper portion of the tail thereto. Such securing means may comprise a simple link, loop, pin, or other structure to hold and operatively retain the tail and first end of the appendage together.

If, however, the pivot point is located at the first end of the appendage, then the tail is connected to the appendage at a point between the first and second ends but closer to the first end. An appropriate connection between the upper portion of the tail and the appendage, as described above, is provided.

The appendage is remotely actuated by animated movement of the tail. For example, longitudinal movement of the tail along a generally upward and downward path causes the appendage, via a linkage, to move within the curved path between its initially lowered position and subsequently raised position. In other words, by pulling upon or releasing the tail of the puppet, the tail urges the appendage to rotate through the predetermined curved path.

As the elongated tail is pulled downward, tensile forces along the length of the tail transmit the pulling force to the operable connection between the tail and the appendage. This causes the appendage to pivot and rotate about the pivot point. As a result of the pivotal action, the second end of the appendage is advanced outwardly and upwardly away from the body of the puppet. Thus, when the tail is pulled, the appendage pivots away from the body of the puppet along a predetermined curved path.

After the appendage reaches its raised position, the motion of the tail and appendage may be reversed and the appendage returns to its initial lowered position. The action of the appendage is defined by the oscillation of the appendage about the pivot point. It is very easy to animate the puppet of the present invention to appear as though it is waving its wings or arms in direct response to the pulling and releasing of its tail. Thus, even an inexperienced child could impart life-like animation to the puppet.

The claimed apparatus and methods further contemplate that the tail may be pulled from a wide range of orientations with respect to the body of the puppet. This allows the puppeteer to alter the angle of tail pulling to either prominently display the pulling and releasing of the tail or to hide the means of activating movement of the wings or arms of the puppet by positioning the elongated tail behind the arm that supports the puppet. This enables the puppeteer to impart a wide variety of life-like attributes and expressions to the puppet.

Several different apparatus and methods may be used to urge the tail and appendage back to their initial positions. For example, the appendage may be provided with sufficient weight near its second end to allow gravity to urge the appendage to pivot toward its initially lowered position.

Alternatively, or in addition to the above-stated weight, the means for urging the appendage toward its initial position may comprise use of a tension member secured between the tail and the body of the puppet. The tension member may comprise a length of elastic fabric or material, or the like. A first end of the tension member is securely attached to the back of the puppet body. The second end of the tension member is securely attached to the tail in such a manner that when the tail is pulled, the tension member is elongated. When the tension within the tail is released, the elongated and stretched tension member urges the tail to move upward with respect to the puppet body and urges the appendage to rotate about the pivot point toward its initial position.

As seen in the drawings, the tension member may be juxtaposed between an inner side of the tail and the back of the puppet body. This completely conceals the existence and operation of the tension member from the viewing audience. This structure automates the retraction of the appendage and tail, and also eliminates the need for other cumbersome and inefficient recoil devices.

An added benefit of using the tension member is that it resists excessive extension. Thus, the tension member bears some of the tensile forces transmitted through the tail, thereby giving greater stability and strength to the tail and preventing detachment of the tail from the appendage.

In an alternative embodiment, a tension member or even a spring may be secured between the appendage and the puppet body. Rather than having the tension member attached to the tail to force the tail and appendage to their original positions, a tension member which is attached to the appendage acts directly upon the appendage to urge it to pivot toward its initial position and thereby remotely pull the tail upward through the linkage.

The present invention requires minimal dexterity and manipulation to operate. It is extremely simple to use.

The present invention increases the speed and simplifies the procedure to manufacture remotely activated hand-held puppets. It also provides inexpensive, unobtrusive means for actuation which requires less access room for operation and eliminates the need for further actuating means such as a separate, independent pull string.

The present invention achieves each of the above-stated objectives and also overcomes the previously mentioned disadvantages of the prior art.

These and other objects and advantages of the present invention will become more readily apparent upon reading the following disclosure and referring to the attached drawings.

BRIEF DESCRIPTION OF DRAWINGS

FIG. 5 is a schematic, partial, rear elevational view, similar to that of FIG. 2, illustrating the attachment of the wings to the puppet body that defines the pivot points and axis of rotation.

FIG. 6 is a partial, cross-sectional, side-elevational view of the back portion, tension member, appendage, and tail of the present invention.

Figure 1:
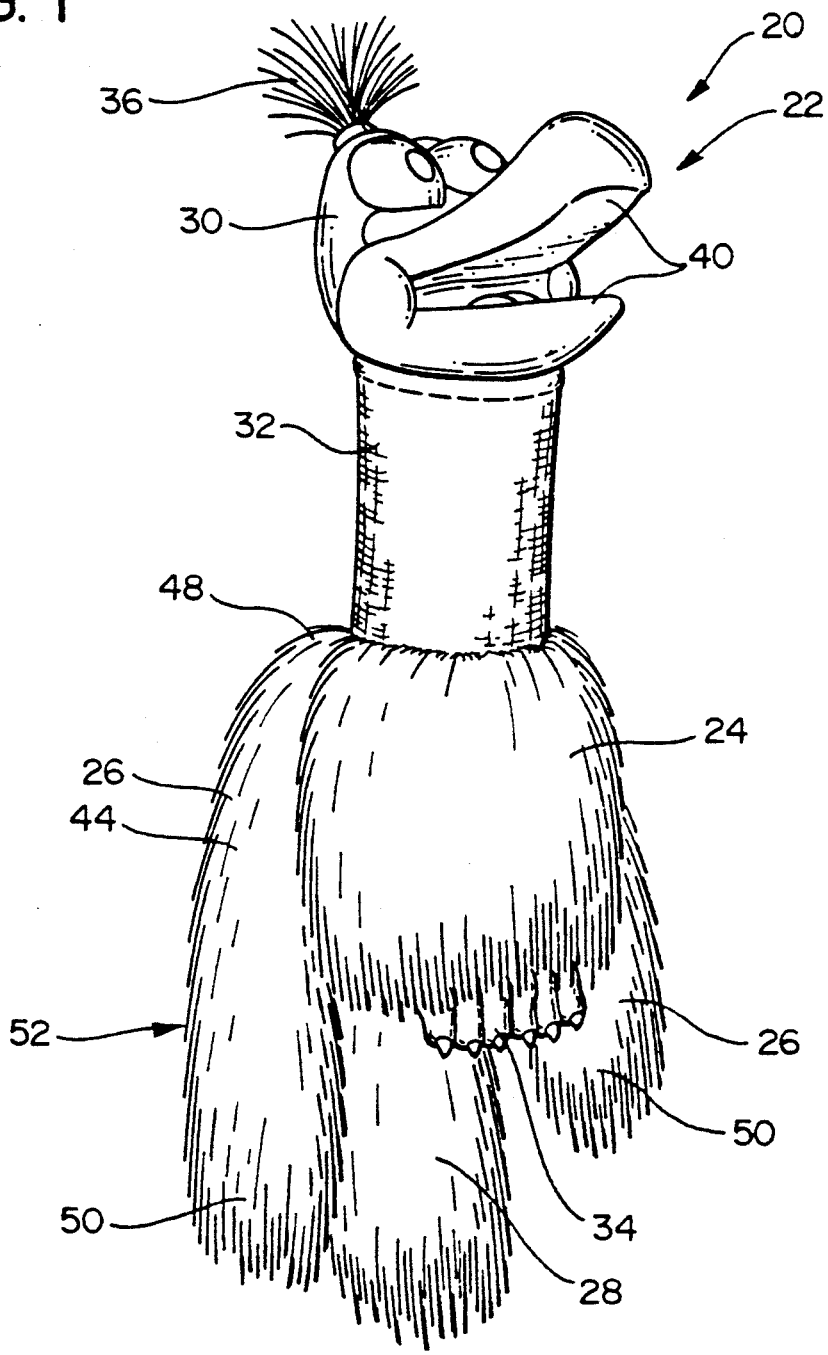
FIG. 1 is an isometric view of the invention, as taught herein, depicting the general appearance of the animal-type puppet of the preferred embodiment.

One should understand that the drawings are not necessarily to scale and the elements are sometimes illustrated by graphic symbols, phantom lines, diagrammatic representations, and fragmentary views. In certain instances, the inventor may have omitted details which are not necessary for an understanding of the present invention or which render other details difficult to perceive.

BEST MODE FOR CARRYING OUT THE INVENTION

Referring to the drawings, wherein like numerals indicate like parts, an apparatus 20 of the present invention, which may be used to animate and impart generally life-like qualities and actions to an animal-type puppet 22, comprises: a body 24; at least one appendage 26; and a tail 28.

The present invention is intended to be used with an animal-type puppet 22, and more particularly a bird-like puppet, which is manipulated by a puppeteer/ventriloquist. Puppet 22 is designed such that the puppeteer's forearm extends upwardly into body 24 with the puppeteer's hand being capable of manipulating the puppet's mouth.

In one embodiment of the invention, puppet 22 further includes a dummy forearm and hand which creates the illusion that puppet 22 is truly sitting upon the puppeteer's arm and that there is nothing within puppet 22 that could possibly activate the mouth.

It is the inventor's intention that puppet 22 have a head 30, a neck 32, body 24, one or more appendages 26 (which simulate wings, arms, legs, or the like, that extend from body 24), and tail 28. Puppet 22 may also have feet 34, hair 36, feathers (not shown) and/or other features that accomplish the desired impression, expression, and purpose of the puppeteer.

The foregoing elements are integrated and secured to one another to impart a general animal-type or cartoon-type impression or appearance to puppet 22.

In the preferred embodiment, as shown in the accompanying drawings, puppet 22 has the general appearance of a comical, cartoon-type bird.

Puppet 22 and body 24 may similarly take the forms of other animals or characters, within the animal and/or cartoon-animated kingdoms, which have at least one appendage 26 and tail 28. For the purposes of the present invention, it is best that the appendages 26 be elongated members that could be attached to a centrally located back portion 38 of body 24. Appendages 26 should also generally lie flat against body 24 when they assume their initial position.

Because of these requirements, the best animal-type and cartoon-type puppets 22 comprise such characters as birds, animals, reptiles, insects, or fish that (in addition to having a tail) have wings, arms, legs, fins and/or other appendages which could be attached to back portion 38 and pivot outwardly from the sides of body 24. For example, but not by way of limitation, puppet 22 may include birds, apes, bears, cats, dogs, tigers, lions, sheep, rodents, turtles, lizards, platypi, kangaroos, dinosaurs, fish, sharks, lobsters, monsters, etc. Whatever character is selected, body 24 is generally shaped to represent the torso of puppet 22.

This invention can be used with stationary and/or robotically-operated puppets 22 which do not require the insertion of the puppeteer's hand into the body cavity.

The concept, however, of this invention is to reduce the complexity and number of components needed to mechanically animate puppet 22. For this reason, the preferred embodiment of puppet 22 comprises a simple, hand-held, hand-operated unit that has a body cavity and opening thereto, and is fitted over one hand (not shown) of the puppeteer. Puppet 22 may be of any size and shape that meets the particular needs of the puppeteer, and preferably is easily held. Body 24, neck 32, and head 30 define the parameters of a cavity located therein and are attached together by means which are well known within the puppet industry, such as by sewing or adhesion.

In addition to the traditional use of body 24 to contain and hide the hand of the puppeteer which controls the animated movement of head 30 and jaws 40, body 24 also serves and functions as a support structure to and upon which one or more appendages 26 and tail 28 are attached.

Appendage 26 defines a pivotal, cantilevered lever, rocker arm, link or crank which can rotate or oscillate about a generally fixed pivot point 42. As previously explained, appendages 26 simulate the wings, arms, legs, or the like, of puppet 22 that extend from body 24. It is anticipated that appendage 26 is an elongated member. Appendage 26 may also be bent or have a posture similar to what a real appendage of the animal might assume.

Figure 2:
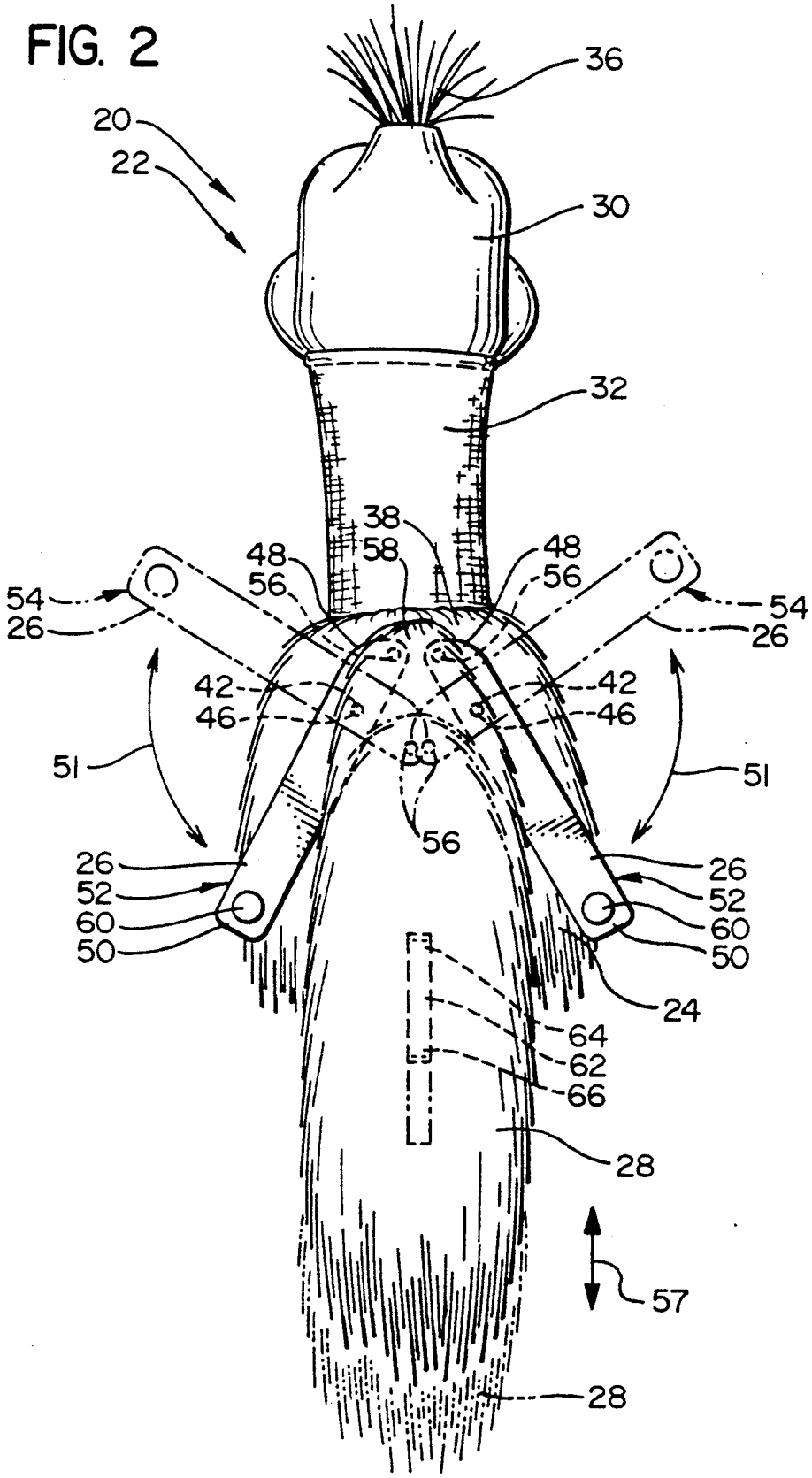
FIG. 2 is a schematic, rear elevational view of the embodiment shown in FIG. 1, wherein portions of the outer covering on the wings have been either removed or shown in phantom lines to illustrate the underlying structure and framework of the wings that move between an initial position and a raised position.
Figure 3:
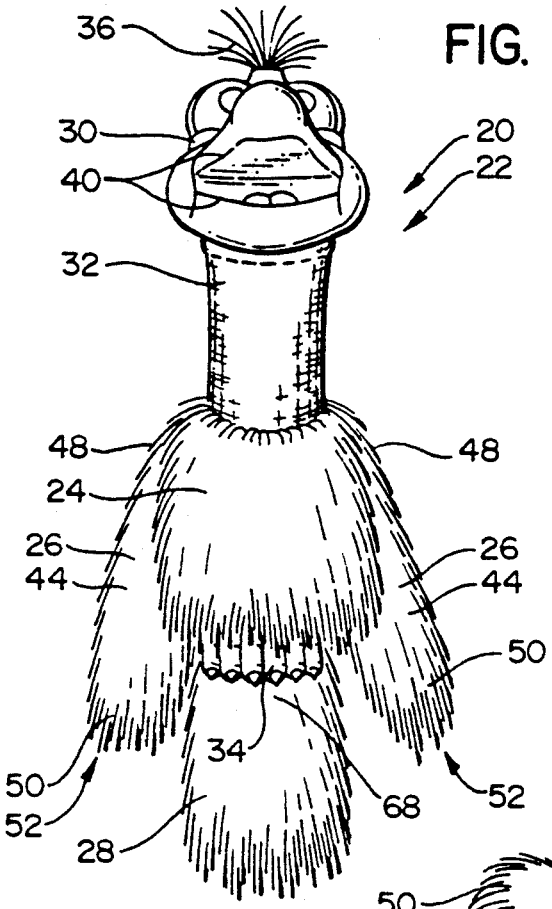
FIG. 3 is a schematic view of the puppet with its wings in its initial lowered position and its tail in an initial raised position.
Figure 4:
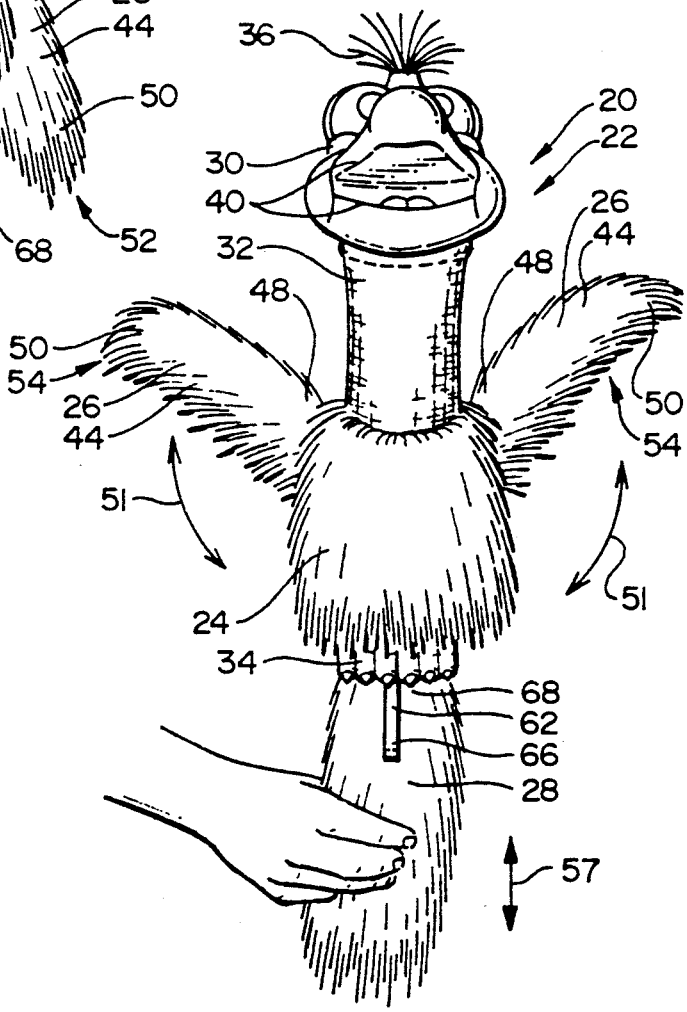
FIG. 4 is a schematic view of the puppet showing that the downward pulling and movement of the tail causes the wings to move toward their outwardly-projecting, raised position.

As shown in FIG. 2, appendage 26 has a first end 48 and a second end 50. First end 48 is positioned near the central back portion 38 of puppet 22.

Appendage 26 is pivotally secured to body 24 at pivot point 42. Pivot point 42 serves as a fulcrum and axis of rotation for appendage 26.

One means of attaching appendage 26 to body 24 is to first provide appendage 26 with a flexible outer covering 44. Outer covering 44 is then sewn, adhered or otherwise attached to body 24 at a particular point which defines pivot point 42. FIG. 6 illustrates a segment of adhesive 45 and stitching 45' securing outer covering 44 to back portion 38.

Outer covering 44 should have sufficient flexibility or looseness about appendage 26 such that appendage 26 may pivot or oscillate about pivot point 42 with relative ease. This may be easily accomplished where body 24 also comprises a flexible covering. For example, as shown in FIG. 6, body 24 may be made of a flexible, natural or man-made fabric.

Alternatively, an interlocking cylindrical pivot pin 46, or other means of pivotal attachment, may be used to engage and attach appendage 26 to body 24 and define pivot point 42. This method of attachment is particularly useful where body comprises a more rigid support surface.

Second end 50 of appendage 26 extends and cantilevers radially outward from pivot point 42.

Various methods and apparatus may be used to cause second end 50 of appendage 26 to pivot or oscillate about pivot point 42. For example, fixed pivot point 42 may be located between first end 48 and second end 50. This creates a mechanical lever mechanism with pivot point 42 serving as the fulcrum. Movement of first end 48 will cause corresponding movement of second end 50.

Alternatively, pivot point 42 may be located at first end 48. This creates a mechanical crank mechanism.

Irrespective of which of these systems is used, pivot point 42 defines the axis of rotation. The length of appendage 26 is largely dependent upon the desired size and shape of puppet 22 and the length of the curved path that appendage 26 is to pass through during animation.

When acted upon, appendage 26 rotates or oscillates about pivot point 42 to pass through a predetermined generally curved path, as generally indicated by arrows 51, between a lowered initial position 52 and a raised subsequent position 54.

Since pivot point 42 is located within the central back portion 38 of body 24, when located in its initial position 52, appendage 26 is oriented to the side and rear of body 24. Appendage 26 is also juxtaposed against or located near body 24 when in its initial position 52.

Rotation or pivotal movement of appendage 26 about pivot point 42 urges second end 50 outward away from body 24 toward its extended, raised position 54.

Puppet 22 is also provided with a tail 28 that extends loosely up the back of puppet 22 and is operatively connected or hinged to appendage 26. When the puppeteer pulls down on tail 28, the movement of tail 28 causes appendage 26 to pivot and lever upward. When tail 28 is repetitively pulled and released, this gives puppet 22 the comical or comedic appearance of flapping its arms, legs, or wings.

Tail 28 may comprise any form which would be appropriate for the particular animal-style chosen. For example, a rabbit may have a generally spherical tail. In comparison, a bird may have an elongated tail 28 which generally depicts elongated tail feathers.

If tail 28 is relatively long in comparison to the length of body 24, elongation due to movement of the tail 28 is not very noticeable. Thus, it is easier to conceal movement of an elongated tail 28 than it is for a relatively small spherical tail.

Another advantage of using an elongated tail 28 is that its orientation with respect to body 24 may be altered to give added effect to the tail-pulling motion. This will be discussed further below.

If pivot point 42 is located between first end 48 and second end 50, tail 28 is operatively connected to first end 48. This creates a lever mechanism with pivot point 42 serving as the fulcrum.

Connection between tail 28 and appendage 26 may be accomplished by providing first end 48 with means 56 for securing an upper portion 58 of tail 28 thereto. Such securing means 56 may comprise a simple link, loop, pin, adhesively bonded or sewn joint, or any other structure which will hold and operatively secure upper portion 58 of tail 28 to first end 48 of appendage 26. In the preferred embodiment, as best shown in FIG. 6, securing means 56 comprises a segment of adhesive 56' and a simple sewn tack stitching connection 56'' between upper portion 58 and first end 48, as is often used to attach buttons to underlying fabric.

Alternatively, if pivot point 42 is located at first end 48, tail 28 is connected to appendage 26 at a point between first end 48 and second end 50. To achieve the best arm or wing movement, it is best that the connection between tail 28 and appendage 26 be located closer to first end 48.

Appendage 26 is remotely actuated by animated movement of tail 28. For example, longitudinal movement of tail 28 along a generally upward and downward path causes appendage 26, via the aforesaid tail-appendage-body linkage, to move within a curved path between initial position 52 and raised position 54. In other words, by pulling upon and/or releasing tail 28, tail 28 urges appendage 26 to rotate through a predetermined curved path defined by its pivotal movement about pivot point 42. This is achieved by the transmission of tensile forces along the length of tail 28 as tail 28 is pulled downward and released in a direction generally indicated by an arrow 57. These forces are transmitted to appendage 26 through its pivotal connection with tail 28, thus causing appendage 26 to pivot and rotate about pivot point 42.

As a result of the pivotal action, second end 50 of appendage 26 is advanced outwardly and upwardly away from body 24. Thus, when tail 28 is pulled, appendage 26 pivots away from body 24 of puppet 22 along a predetermined curved path.

After reaching its raised position 54, the motion of tail 28 and appendage 26 may be reversed such that appendage 26 returns to its initial position 52. Thus, the animated action of appendage 26 is defined by the oscillation of appendage 26 about pivot point 42.

It is extremely easy, even for a child with minimum hand dexterity, to cause one or more appendages 26 of puppet 22 to appear as though they are frantically waving in direct response to the pulling and releasing of tail 28. Consequently, even an inexperienced child can impart lifelike animation to puppet 22.

As mentioned above, the claimed apparatus and methods further contemplate that tail 28 may be pulled from a wide range of orientations with respect to body 24. This allows the puppeteer to alter the angle of tail 28 to prominently display the pulling and releasing of tail 28. Alternatively, the puppeteer may hide the means of activating movement of the wings or arms of puppet 22 by positioning tail 28 behind the puppeteer's arm (not shown) which supports puppet 22. This enables the puppeteer to impart a wide variety of lifelike attributes and expressions to puppet 22.

Various means may be used to urge tail 28 and appendage 26 back to their initial positions 52. For example, appendage 26 may be provided with sufficient weight near its second end 50 to allow gravity to urge appendage 26 to pivot toward its initial position 52. Additional weight 60 may be secured to appendage 26, and particularly to second end 50, if needed and/or desired. For example, relatively flat washers may be adhered to the underlying structure of appendage 26 as indicated in FIG. 2.

Alternatively, or in addition to the use of weight 60, means for urging appendage 26 toward its initial position 52 may comprise use of an elongated tension member 62. Tension member 62 may comprise a length of latex, rubber, elastic fabric, a helical tension-spring, or other structure that is capable of automatically retracting, biasing, or urging tail 28 and appendage 26 toward their initial positions 52.

As seen in the drawings, tension member 62 may be juxtaposed between inner surface 68 of tail 28 and back portion 38 of body 24. This completely conceals the existence and operation of tension member 62 from the viewing audience. Tension member 62 has a nearer end 64 and an extended end 66. Nearer end 64 is securely attached to back portion 38 of body 24 by any adequate means, such as by sewing or by adhesion at a location 64', as shown in FIG. 6. Extended end 66 is similarly securely attached to an inner surface 68 of tail 28 at a location 66', as shown in FIG. 6.

Tension member 62 is secured in such a manner that when tail 28 is pulled, tension member 62 is elongated. When tension within tail 28 is released, the elongated and stretched tension member 62 urges tail 28 to move upward with respect to body 24 and thereby urge appendage 26 to rotate about pivot point 42 toward its initial position 52.

An added benefit of using tension member 62 is that it partially restricts lateral movement with respect to body 24 and resists excessive extension. Thus configured, tension member 62 bears some of the tensile forces transmitted through tail 28. This gives the claimed apparatus greater stability and strength by distributing the tensile forces to more than a single point, thereby, helping prevent detachment of tail 28 from appendage 26.

In an alternative embodiment, rather than having tension member 62 be attached to tail 28, tension member 62 is secured between appendage 26 and body 24. In this embodiment, tension member 62 acts directly upon appendage 26 to urge it to pivot toward its initial position 52. The rotation of appendage 26 to its initial position 52 causes tail 28 to be remotely pulled upward to its initial position.

The means and construction disclosed herein are by way of example and comprise primarily the preferred form of putting the invention into effect. Although the drawings depict a preferred embodiment of the invention, other embodiments have been described within the preceding text. One skilled in the art will appreciate that the disclosed device may have a wide variety of shapes and configurations. Additionally, persons skilled in the art to which the invention pertains might consider the foregoing teachings in making various modifications, other embodiments, and alternative forms of the invention.

It is, therefore, to be understood that the invention is not limited to the particular embodiment or specific features shown herein. To the contrary, the inventor claims the invention in all of its forms, including all alternatives, modifications, equivalents, and alternative embodiments which fall within the legitimate and valid scope of the appended claims, appropriately interpreted under the Doctrine of Equivalents.

INDUSTRIAL APPLICABILITY

The present invention may be used within the puppet and toy industries, wherein simple, reliable, easily manufactured and used apparatus and methods are needed to actuate and animate an animal-type puppet to impart life-like qualities and actions thereto. This invention allows actuation and animated appendage movement in response to a tail being pulled as might occur with a live animal. The tail may be pulled from a wide range of orientations with respect to the body of the puppet.

The apparatus of this invention is efficient, functional, compact, unobtrusive, is easily constructed, and is inexpensive to manufacture. The present invention increases the speed and simplifies the procedure to manufacture remotely actuated puppet appendages. This invention also provides an apparatus which requires the manufacture, installation, and use of a fewer number of previously required elements.

I claim:

1. An animatable puppet simulating a hand-manipulable, animal-like caricature of the type having a tail and arm or wing appendages, said puppet comprising, in combination:

a) a hollow body having left, right, front and rear sides, an integral hollow neck, and a hollow head including manually manipulable jaws, said hollow body, neck and head dimensioned to receive and accommodate the hand and forearm of a puppeteer enabling manual animated manipulation of said puppet's jaws;

b) a pair of left and right appendages simulating one of a pair of wings and a pair of arms each including a lever element having first and second ends and a flexible outer covering simulating one of feathers or skin, said flexible outer covering surrounding and substantially covering each said lever element including at least said second ends thereof;

c) means for pivotally securing each of said left and right appendages to the outer upper rear side of said hollow body at a point adjacent: i) said first end of said lever element; and ii), the approximate mid-point of said hollow body's upper rear side, said securing means comprising means for fixedly attaching said flexible outer surface to said hollow body so as to permit normal positioning of said left and right appendages in a non-deployed position adjacent and closely proximate said rear side and respective ones of said left and right sides of said hollow body;

d) means simulating an elongate animal-like tail having its upper end secured to rigid lever elements of said left and right appendages adjacent said first ends thereof and adjacent to, but slightly spaced from, said pivotal securing means; and, e) means for normally biasing said left and right appendages toward said non-deployed position where said left and right appendages are adjacent and closely proximate said rear side and respective ones of said left and right sides of said hollow body member;

whereby, when the puppeteer grasps said tail simulating means and pulls downwardly thereon relative to said hollow body, said left and right appendages are pivoted about said pivotal securing means outwardly away from and upwardly with respect to said hollow body and against said biasing means, and when the puppeteer releases said tail simulating means, said biasing means returns said left and right appendages to said normally non-deployed position, thereby simulating movement of said left and right appendages.

2. A puppet as set forth in claim 1 wherein said biasing means is gravity actuated and defined by the weight of the free extremities of said left and right appendages.

3. A puppet as set forth in claim 2 wherein said biasing means includes discrete weights secured to the free extremities of said left and right appendages.

4. A puppet as set forth in claim 1 wherein said biasing means includes extensible/retractable tension members having their opposite ends secured to respective different ones of: i) said first end of said lever elements in each of said left and right appendages; and ii), said tail simulating means, and is adapted to bias said left and right appendages towards said normal non-deployed position.

5. A puppet as set forth in claim 4 wherein said tension members are elastic.

6. A puppet as set forth in claim 1 wherein said biasing means includes extensible/retractable tension members having their opposite ends secured to respective different ones of: i) each of said left and right appendages; and ii), said hollow body.

7. A puppet as set forth in claim 6 wherein said tension members are elastic.

8. A puppet as set forth in claim 1 wherein said means for fixedly attaching said flexible outer surface to said hollow body comprises at least one of: i) an adhesive bond between said flexible outer surface and said body; ii) stitching interconnecting said flexible outer surface and said hollow body; and iii), pivot pins interconnecting said left and right appendages and said body.

* * * * *